United States Patent [19]

Owen

[11] 3,951,302

[45] Apr. 20, 1976

[54] TRASH BIN LID

[75] Inventor: Calvin P. Owen, San Diego, Calif.

[73] Assignee: Allan M. Hodge, San Diego, Calif.

[22] Filed: Aug. 5, 1974

[21] Appl. No.: 494,388

[52] U.S. Cl. ..... 220/331; 220/1 T

[51] Int. Cl.[2] ..... B65D 43/14

[58] Field of Search ..... 220/331, 1 T, 318

[56] References Cited

UNITED STATES PATENTS

| | | | |
|---|---|---|---|
| 2,238,511 | 4/1941 | Thaxter | 220/96 |
| 2,276,635 | 3/1942 | Weber | 220/96 |
| 2,338,477 | 1/1944 | Wolters | 220/331 |
| 2,357,214 | 8/1944 | McDole | 220/331 |
| 2,416,132 | 2/1947 | Watson | 220/331 |
| 2,682,351 | 6/1954 | Durand | 220/331 |
| 3,487,887 | 1/1970 | Pensa | 220/331 |

*Primary Examiner*—William Price
*Assistant Examiner*—Ro E. Hart

[57] ABSTRACT

A trash bin lid for covering a rectangular top edge of a trash bin in which front and back sections are provided, each of said front and back sections having a raised back portion thereof with the front section having a roller captured within a track on the top of the back section and a roller in the front portion of the front section riding on the trash bin ledge whereby the front section of the trash bin lid can be pushed toward the rear, allowing the back roller to ride up the back section of the trash bin lid, at which time trash can be dropped into the trash bin and the front section of the trash bin released, allowing it to gravity close. The back lid section is hingedly attached to the back edge of the bin so that when dumping, i.e., inverting the bin, both lid sections extend downwardly from the top edge of the bin.

2 Claims, 5 Drawing Figures

TRASH BIN LID

BRIEF DESCRIPTION OF THE INVENTION

The present invention relates to a trash bin lid and more particularly to a self-closing trash bin lid.

According to the invention, a trash bin lid is provided for forming a closure over a rectangular commercial trash bin such as utilized in apartment houses, hospitals, hotels, etc. Each side of the trash bin lid has a roller track thereon moving about halfway from the front edge of the trash bin lid to the back edge of the trash bin lid. A front section of the trash bin lid is on rollers, one set being in the roller track on the edges of the trash bin lid and the other set being in an inclined roller track on a back section of the trash bin lid trapped therein. To open the trash bin, the front section is pushed back which rolls it along the side edges of the trash bin lid and the top edges of the second or back section of the trash bin lid. When released, the front section of the trash bin lid rolls back, covering the exposed bin by gravity. The back portion of the roller track on the back section of the trash bin lid can dip downwardly to trap the back rollers of the front section of the trash bin lid and hold it in an open position, if desired. The back portion of the front section of the trash bin lid can be raised also so that the top of the front portion of the trash bin lid forms a more steeply inclined surface for guiding garbage into the exposed open portion of the trash bin when the front section of the trash bin lid is rolled to its rearward position.

An object of the present invention is the provision of an improved trash bin lid.

Another object of the invention is the provision of a trash bin lid which can be self-closing.

A further object of the invention is the provision of a trash bin lid which is rolled open.

Yet another object of the present invention is the provision of a trash bin lid which requires a minimum of effort for opening.

Other objects and many of the attendant advantages of the present invention will be readily understood when considered with reference to the following detailed description of the accompanying drawings in which like reference numerals designate like parts throughout the Figures thereof and wherein.

DETAILED DESCRIPTION OF THE DRAWING

Figure 1:
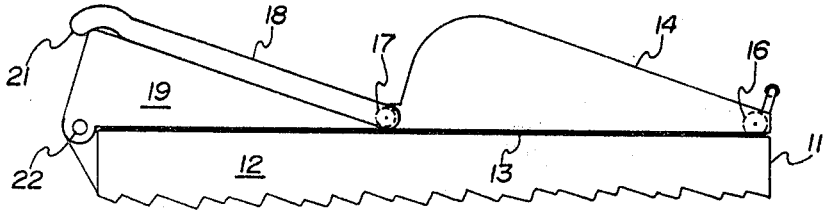
FIG. 1 is a side elevational view of the preferred embodiment of the present invention.

Referring to FIG. 1, bin 11 with side 12 has a top edge and roller track 13. Front lid section 14 has a roller 16 on roller track 13 and a roller 17 trapped within roller track 18 of back section 19 of the trash bin lid. Roller track 18 terminates in a downward section 21. Back section 19 is hingedly attached to the back corner of bin 12 at 22.

Figure 2:
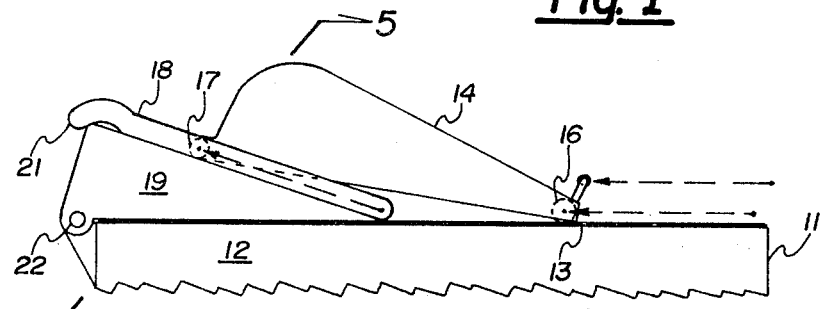
FIG. 2 is a side elevational view of the embodiment of FIG. 1 partially opened.

Referring to FIG. 2, front section 14 has been pushed away from the front edge of bin 11 along roller track 13. Back roller 17 of front section 14 has regressed up roller track 18 of back section 19.

Figure 3:
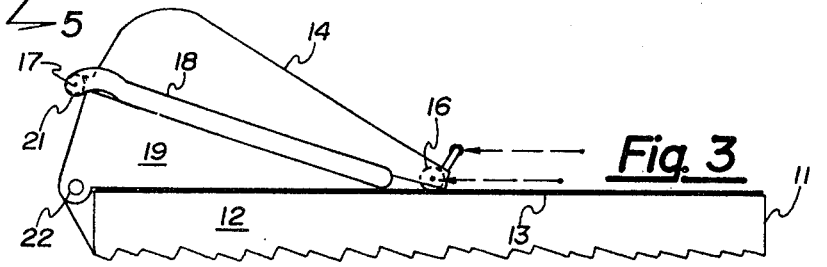
FIG. 3 is a side elevational view of the embodiment of FIG. 1 fully opened.

Referring to FIG. 3, front section 14 is shown in a fully open position with front roller 16 abutting roller track 18 of back section 19. Back roller 17 of front section 14 is shown in the downwardly directed termination 21 of roller track 18.

Figure 4:
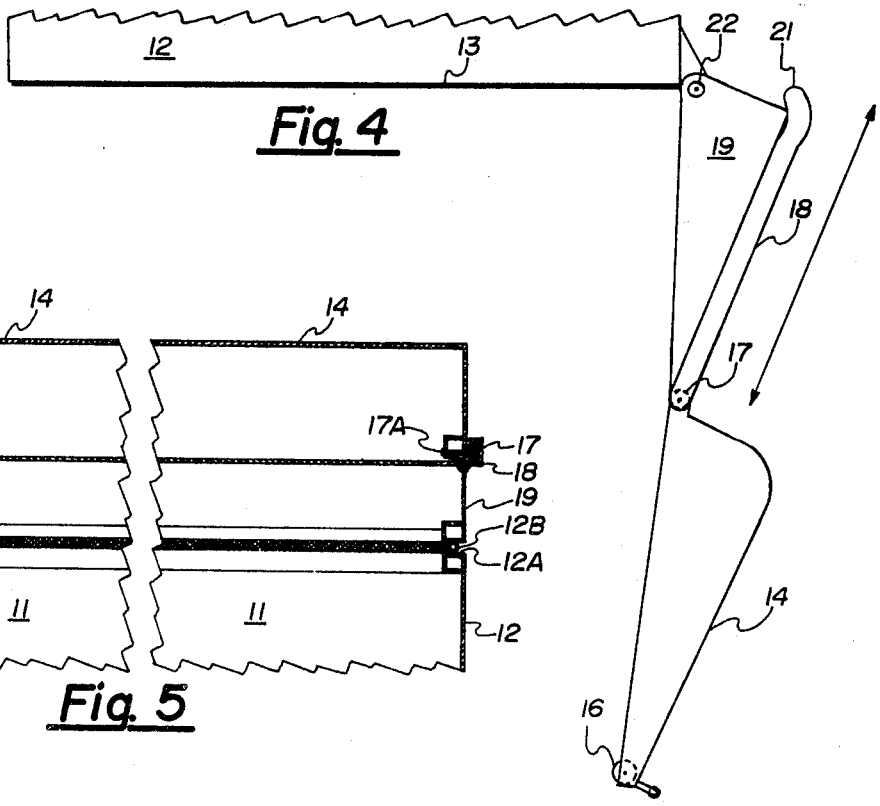
FIG. 4 is a side elevational view of the embodiment of FIG. 1 in a dumping position.

Referring to FIG. 4, bin 11 is shown after having been inverted for dumping with back section 19 shown rotated downwardly on its hinge 22 and back roller 17 of front section 14 at the front end of roller track 18 of back section 19.

Figure 5:
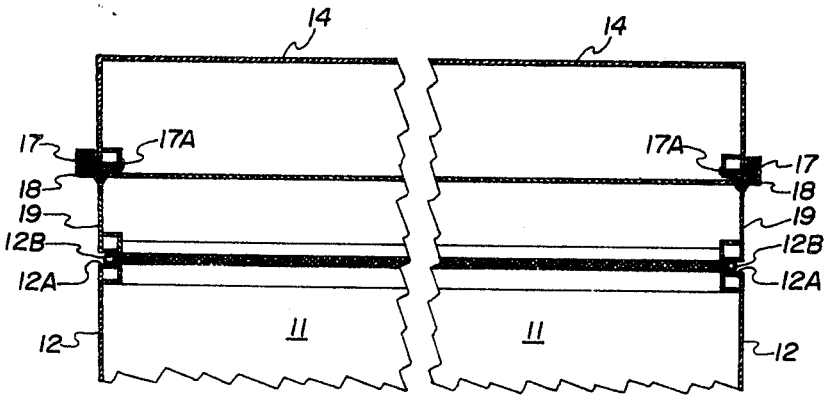
FIG. 5 is a sectional view taken along lines 5—5 of FIG. 2.

Referring to FIG. 5, sides 12 of the bin is shown having top surfaces 12A with seals 12B on which rests back cover 19. Front section 14 has roller 17 rotatably coupled thereto at 17A and captured within track 18 of back section 19.

OPERATION

Referring back to FIG. 1, it can be seen that quiescently, with the bin 11 in its normal upright position, front section 14 has rolled to a sealing position over the front portion of bin 11 with roller 16 against one stop and roller 17 against the terminating lower end of track 18 of back section 19.

Referring back to FIG. 2, it can be seen that by pushing front section 14 to the rear, roller 16 in track 13 and roller 17 in track 18 moves backwards with the back portion of front section 14 of the trash bin lid moving upward along the inclined track 18 of back section 19. At its fully opened position (FIG. 3), roller 17 of front section 14 is against the terminating portions 21 of track 18 which traps front section 14 in the position shown. In the alternative, this downwardly protruding portion 21 of track 18 can be eliminated so that there is no chance that front section 14 can be hung up in the position shown. When it is desired to close the trash bin, front section 14 can be merely released in the absence of roller 17 being trapped as shown in FIG. 3, or it can be pulled slightly forward as to pull it out of the terminating section 21 as shown in FIG. 3.

Referring to FIG. 4, bin 11, together with the lid is shown in the dumping position, i.e., in an inverted position, with the roller 17 fully dropped down track 18 of back section 19 and the two sections opening downwardly for dumping.

It should be understood, of course, that the foregoing disclosure relates to only a preferred embodiment of the present invention, and that it is intended to cover all changes and modifications of the example of the invention herein chosen for the purposes of the disclosure, which do not constitute departures from the spirit and scope of the invention

The invention claimed is:

1. A trash container lid system comprising:

a lid assembly having separate front and rear sections;

a trash bin having first and second sides with first and second roller tracks on the top edges thereof;

third and fourth roller tracks located on the top of the rear lid section and on an incline plane with the top edges of said trash bin;

said front lid section having first and second pairs of rollers rotatably coupled to a front and rear portion respectively of said front lid section;

said first pair of rollers being received by said first and second roller tracks on said trash bin edges;

said second pair of rollers being captured within said inclined third and fourth roller tracks on said top of the rear section; and a pivotal connection between a back portion of said rear lid section and a back portion of said trash bin for rotating said lid sections to a full open position.

2. The trash container lid system of claim 1 wherein: said third and fourth roller tracks on the top of the rear lid section terminate in a downwardly extending section for holding said front lid section in a position above said rear lid section.

* * * * *